US005581970A

United States Patent [19]

O'Shea

[11] Patent Number: 5,581,970

[45] Date of Patent: Dec. 10, 1996

[54] "D" CHANNEL MEMBER FOR USE IN SIDING

[76] Inventor: Darin L. O'Shea, 9314 Ridge Rd., Middleport, N.Y. 14105

[21] Appl. No.: 527,854

[22] Filed: Sep. 14, 1995

Related U.S. Application Data

[63] Continuation of Ser. No. 172,543, Dec. 23, 1993, abandoned.

[51] Int. Cl.[6] ..... E04C 2/38

[52] U.S. Cl. ..... 52/718.01; 52/656.1; 52/204.53

[58] Field of Search ..... 52/204.53, 211, 52/212, 717.01, 718.01, 716.8, 288, 656.1, 730.4; 49/504, 505

[56] References Cited

U.S. PATENT DOCUMENTS 4,949,506 8/1990 Durham, Jr. .

*Primary Examiner*—Carl D. Friedman
*Assistant Examiner*—Creighton Smith
*Attorney, Agent, or Firm*—Jaeckle, Fleischmann & Mugel

[57] ABSTRACT

A channel member for securing lap siding about an opening in a structure, comprising a first substantially flat section arranged to mount the channel member to a surface of the structure; a second section extending outwardly from an edge of the first section and also extending essentially perpendicularly outwardly from the first section; a third section extending perpendicularly from an edge of the second section and arranged in a spaced apart parallel relationship with respect to the first section; and, a fourth section secured to the first and third sections in a spaced apart parallel relationship with respect to the second section, wherein the first, second, third and fourth section form a closed drainage channel.

9 Claims, 4 Drawing Sheets

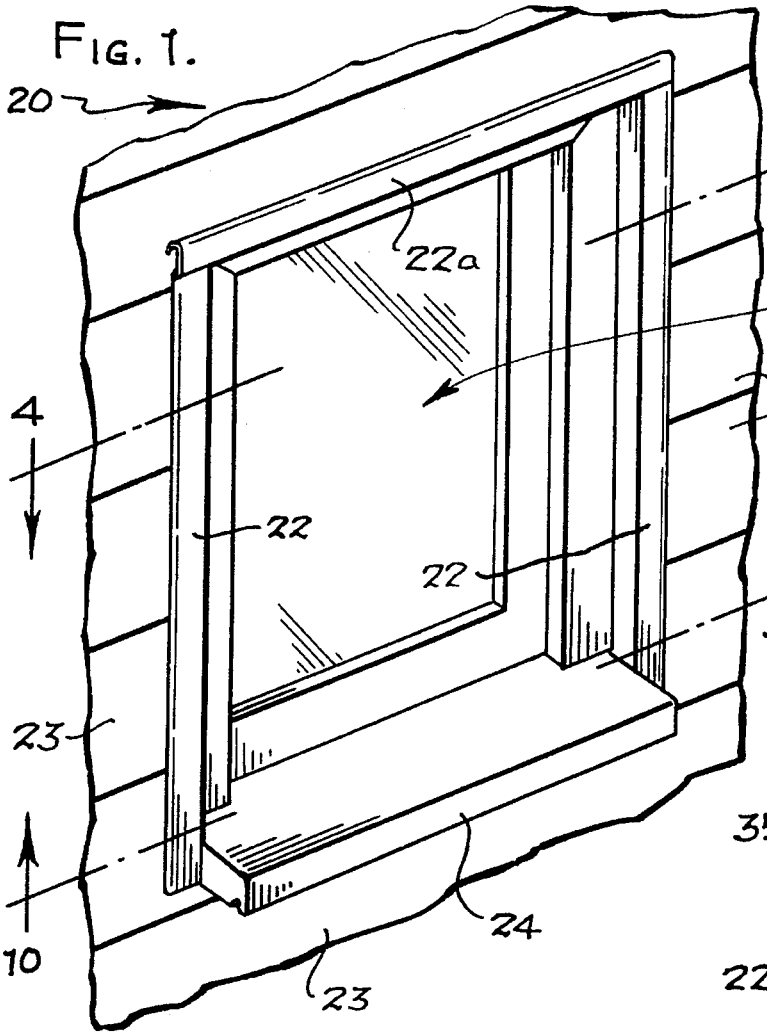
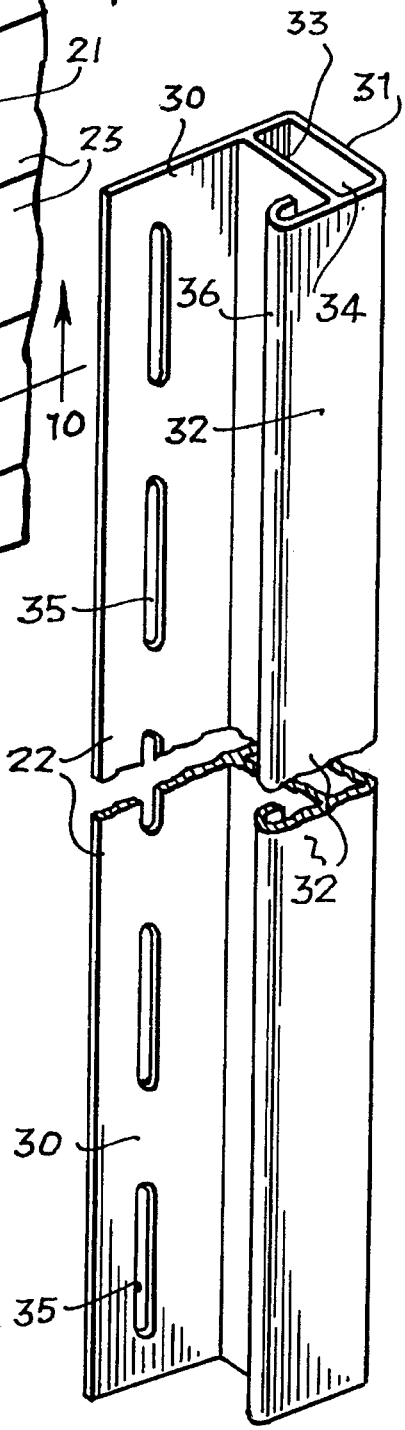
FIG. 2.
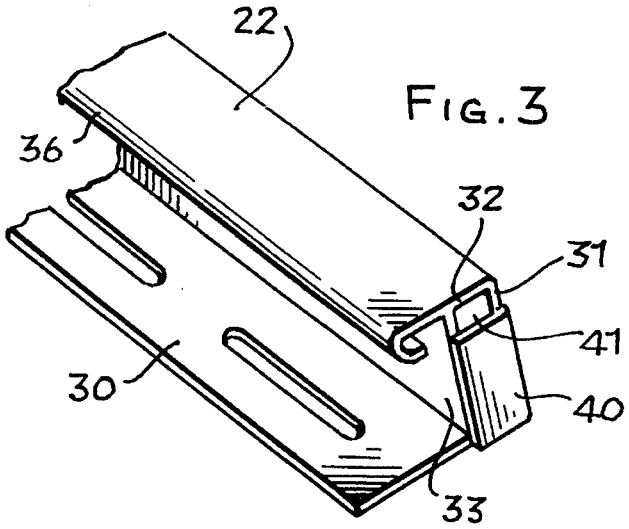
FIG. 3

7
60
22a
71
7
23
60
30
50
22
34
23
72
41
61

50

22a
22
71
61
34
61

62
70
36
63
64
22
30

32
9A
22
70
62
9
68
36
9
30
33
64
66
9A
63

30
33
64
66
50
62
63
61
22
61
50

30
32
33
22
64
66
68
63

"D" CHANNEL MEMBER FOR USE IN SIDING

This application is a continuation of application Ser. No. 08/172,543 filed Dec. 23, 1993 which application is now abandoned.

BACKGROUND OF THE INVENTION

The invention relates generally to siding and, more particularly, to a "D-channel" member for use in securing siding about openings in a building structure.

Presently, most windows and doors are framed with a J-channel member before siding is installed. Unfortunately, J-channel allows water to drain or be carried by capillary action behind the siding after the siding is installed, thereby creating an environment which may encourage the deterioration of the material under the siding (wood panels, etc.), because of mildew, rot or general water damage.

The warm and moist environment created by the deterioration of the wood may also increase the potential for infestation by insect pests such as ants, termites, bees, wasps or the like.

Further, since such conditions often remain undetectable until substantial deterioration has occurred, extensive and costly repairs are often necessary.

Thus, a longfelt need has existed for an alternative to conventional J-channel, which alternative would prevent water from traveling behind the siding.

SUMMARY OF THE INVENTION

The present invention is a channel member for securing lap siding about an opening in a structure, comprising a first substantially flat section arranged to mount the channel member to a surface of the structure; a second section extending outwardly from an edge of the first section and also extending essentially perpendicularly outwardly from the first section; a third section extending perpendicularly from an edge of the second section and arranged in a spaced apart parallel relationship with respect to the first section; and, a fourth section secured to the first and third sections in a spaced apart parallel relationship with respect to the second section, wherein the first, second, third and fourth sections form a closed drainage channel.

A principal object of this invention is to provide a new channel member, hereinafter referred to as a "D-channel " member, for use in securing lap siding of a nature whereby water filtration can be readily dissipated.

A further object of the present invention is to provide a D-channel member which forces draining water to flow down the channel and then out and over the outside surface of the siding.

Yet another object is to provide a separate passageway for drain water, which passageway is partially occluded at the bottom, forcing the water to spill out at the furthest distance from the surface being sided.

Still another object is provide a D-channel member that will reduce the amount of extraneously applied sealing material necessary to prevent water drainage behind the siding.

These and other objects of the present invention may be achieved utilizing a D-channel member for securing lap siding about an opening of a structure as described in the following specification and appended drawings.

BRIEF DESCRIPTION OF THE DRAWINGS

FIG. 1 a perspective of the exterior of a window of a structure such house;

FIG. 2 is fragmentary perspective of the present invention;

FIG. 3 a fragmentary perspective of the lower end portion of the present invention;

FIG. 6 is a similar view as in FIG. 6 showing the prior art;

DETAILED DESCRIPTION OF THE PREFERRED EMBODIMENTS

Figure 4:
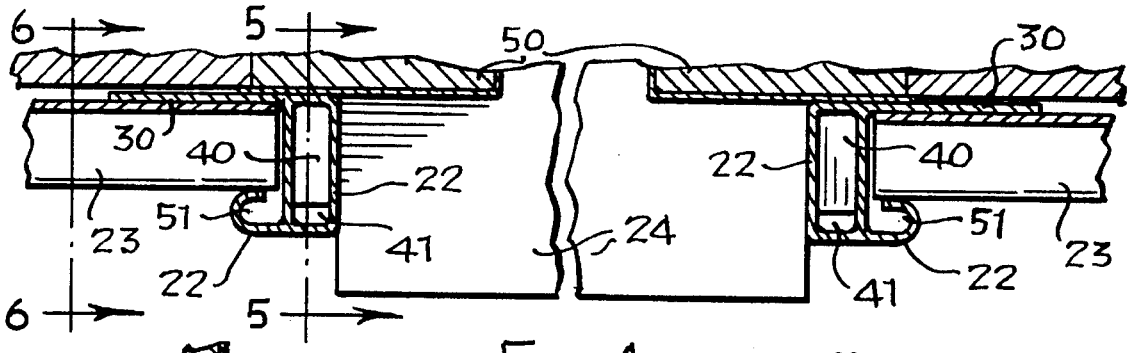
FIG. 4 is a horizontal sectional view taken generally along line 4—4 of FIG. 1.

The D-channel member of the present invention can be made of essentially any appropriate non-deteriorating, ultraviolet and weather-resistant, relatively rigid material. However, in a preferred embodiment, the present invention comprises a predetermined standard length of D-channel which has preformed and polished end pieces (diverters) and is produced in both right-handed (i.e., channel on right), and left-handed (i.e., channel on left), versions for placement about an opening in a structure. The preformed end pieces are preferably removable end pieces which are placed on the end of a D-channel member and sealed with an appropriate sealing means (e.g., vinyl glue.) Furthermore, both the D-channel and the preformed end pieces can be manufactured according to known plastic extrusion techniques.

The rigidity of the material can be varied to provide for ease of use about radiused openings, i.e., a material of less rigidity can be more easily formed about a radiused opening.

Although the present invention preferably comprises essentially a one-piece plastic extrusion made from a plastic material comprising a vinyl or polyvinyl resin (e.g., vinyl acetate resin, polyvinyl acetal resin, polyvinyl chloride, polyvinyl fluoride, polyvinyl formate resin, polyvinylidene chloride or like materials), it may also be comprised of a plurality of separate and distinct pieces, e.g., a standard length of D-channel and a separate preformed end piece or pieces (one for each end of the D channel).

The D-channel of the present invention may also be made essentially of a metal such as aluminum or alloys thereof.

Although the present invention is primarily useful for securing siding about an opening in a structure, other uses, where the drainage characteristics of the present invention could be advantageously applied, are possible. For example, the present invention could be used in conjunction with concrete blocks or other like materials used to construct structural foundations. All such uses are considered to be within the scope and spirit of the present invention.

To the accomplishment of the foregoing and related ends, the invention, then, comprises the features hereinafter described and particularly pointed out in the claims, the following description and the annexed drawings setting forth in detail a certain illustrative embodiment of the invention, this being indicative, however, of but one of the various ways in which the principles of the invention may be employed.

Referring now in detail to the drawings, in FIG. 1 there is shown a perspective of the exterior of a building structure 20, such as a house or other dwelling, having a window 21. Lap siding 23 is mounted on the exterior surface 50 (shown in FIG. 4) of the house and surrounds the window 21. The window 21 is framed on the left and right sides by the D-channel 22 and on top by a J-channel 22*a* which secures the lap siding 23 about the window 21. A window sill 24 is located at the base of the window 21.

FIG. 2 shows a fragmentary perspective view of D-channel 22 (arranged as a vertical side member as shown in FIG. 1) which comprises a first substantially flat section 30 arranged to mount the D-channel to a surface of a structure; a second section 31 extending outwardly from an edge of the first section 30 and also extending essentially perpendicularly outwardly from the first section; a third section 32 extends perpendicularly from an edge of the second section 31 and arranged in a spaced apart parallel relationship with respect to the first section 30; and, a fourth section 33 secured to the first and third sections 30 and 32, respectively, and arranged in a spaced apart parallel relationship with respect to the second section 31, wherein the first, second, third and fourth sections form a closed channel 34. Also shown are multiple elongated slits 35 in the first section 30 which provide a plurality of attachment points for the D-channel member.

Further shown is an in-turned annular lip 36 which allows for the creation of an open drainage space 51 when the lap siding is mounted flush against the D-channel member (see FIG. 4).

FIG. 3 shows a fragmentary perspective of the lower end portion of the D-channel 22 shown in FIG. 2 wherein a fifth section 40 is secured at one end of the closed channel 34 to edges of the first section 30, second section 31, and fourth section 33 to partially occlude the channel 34, and to form a drainage opening 41 between the second, third, fourth and fifth sections.

FIG. 4 is a horizontal sectional view taken generally along line 4—4 of FIG. 1 and shows the drainage opening 41 and the fifth section 40 (also called a diverter) which partially occludes the channel 34 (shown in FIG. 2) and diverts water into opening 41. The drawing shows how the D-channel 22 is secured to the solid underlying surface material 50, (e.g., wood, etc.), and also shows how lap siding 23 is mounted to the D-channel.

Also shown in FIG. 4 is open drainage space 51 which is created by the in-turned annular lip 36 after lap siding 23 has been mounted flush with the D-channel member 22. Drainage space 51 would drain any water which enters the space from a side of the channel. Such water might be blown in along the siding and under the channel. It can also be readily appreciated with respect to FIG. 4 that any water draining through channel 34 will be discharged through drainage space 41, and thus directed away from surface 50. This water would result from drainage of water from the channel positioned on the top of the opening of the structure.

The in-turned annular lip 36 of the D-channel ensures a snug fit against a window, door or louver frame surrounding the window, and also securely hugs the ends of the siding to aid in holding the siding down and enhancing the overall appearance.

Figure 5:
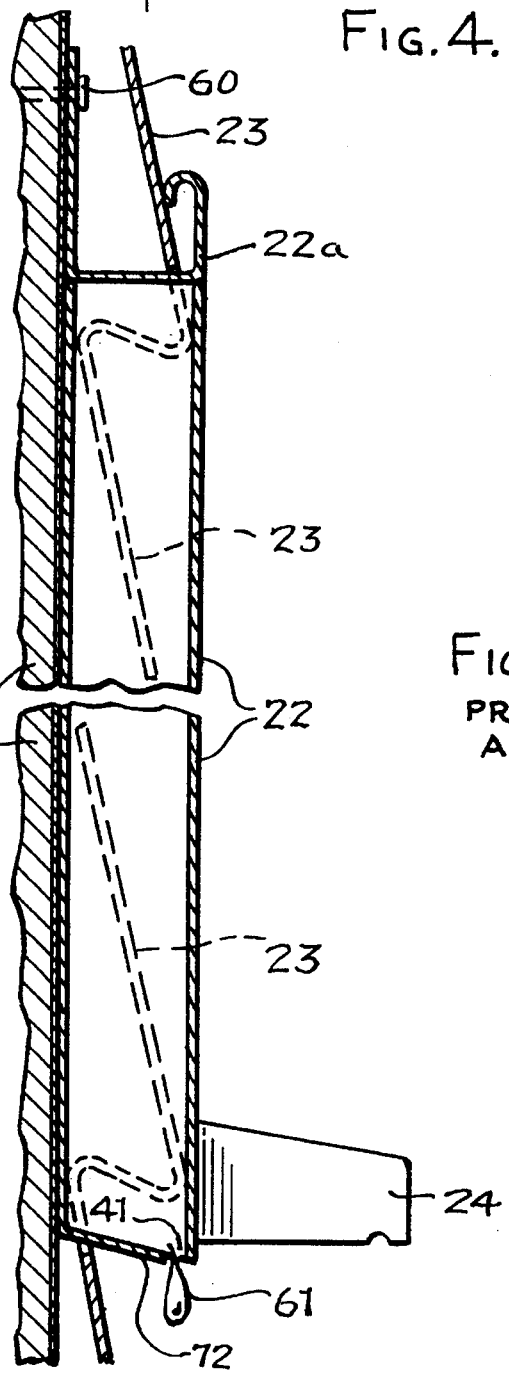
FIG. 5 a fragmentary vertical section taken generally along line 5—5 of FIG. 4.

FIG. 5 is a fragmentary vertical section taken generally along line 5—5 of FIG. 4 which shows the lap siding 23 as viewed through the D-channel member 22 which is secured to the surface 50 of a structure by fastening means 60, such as corrosion-resistant roofing nails. The distribution of drainage water 61 through drainage space 41 and away from the surface material 50 of the structure is clearly shown. FIG. 5 also illustrates an alternative embodiment in that end piece 40, which is positioned perpendicularly to sections 30, 31, 32, and 33, has been replaced by angled end piece 72, which directs water 61 through opening 41.

Figure 5A:
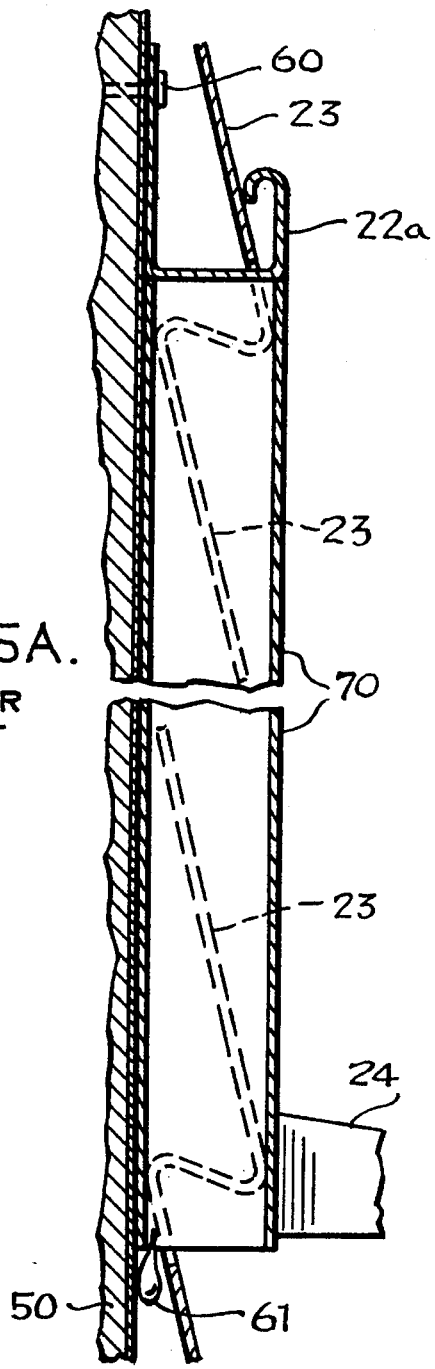
FIG. 5A. PRIOR ART
FIG. 5A is a similar view as in FIG. 5 except showing the prior art.

FIG. 5A is a similar view to FIG. 5 except showing prior art J-channel. The prior art J-channel member 70 allows drainage water 61 to flow toward the surface material 50 of the structure.

Usually, extraneous sealants, such as caulking materials, are applied to the interfaces of prior art channel members and the lap siding during installation. This procedure is done to try to prevent the flow of drainage water behind the siding. Such sealing materials are costly if used in sufficient quantity. These sealants are obviated by the present invention.

Figures 6, 6A, 7, 8, 8A, 9, 9A:
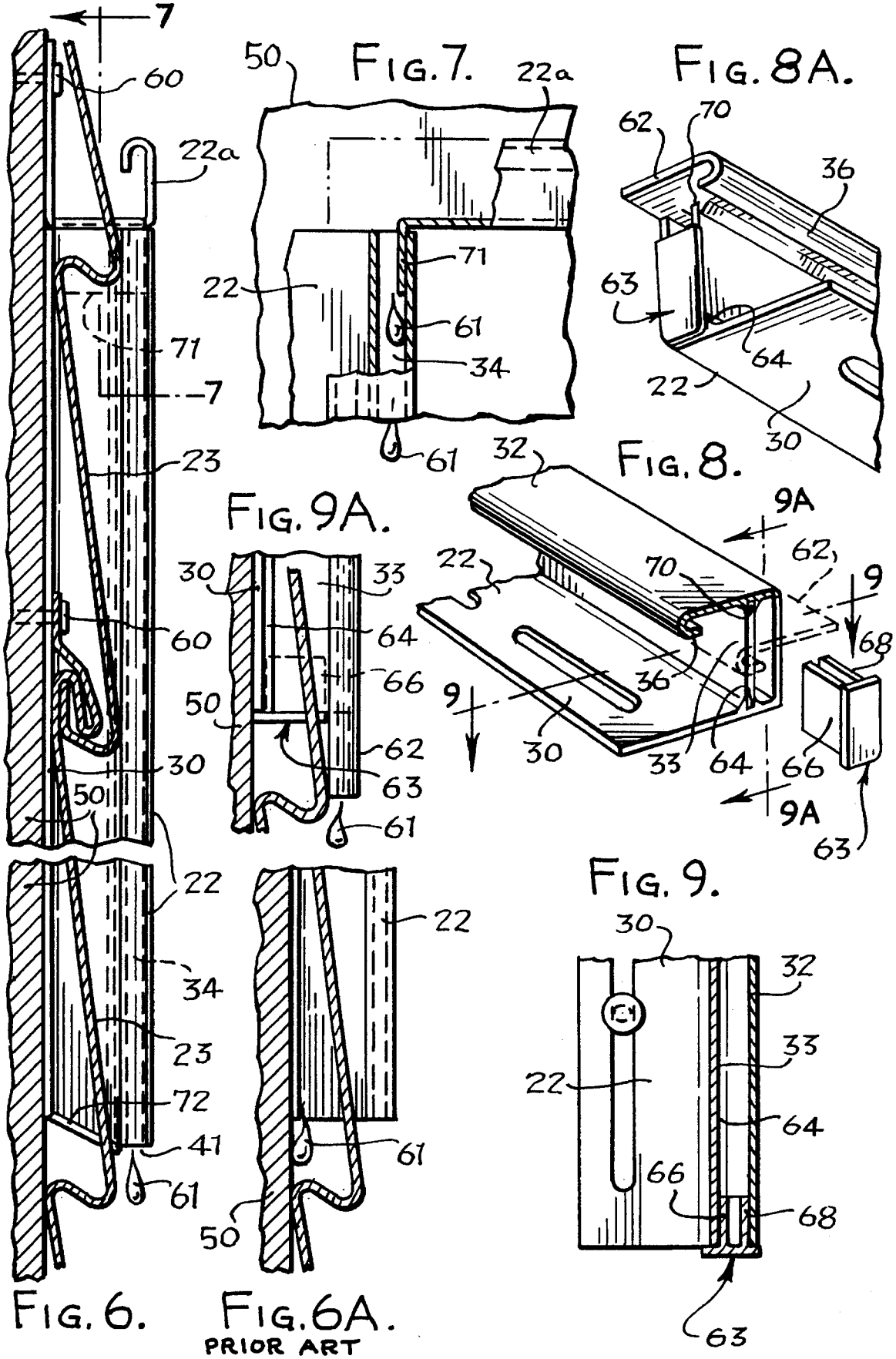
FIG. 6A. PRIOR ART
FIG. 6 is a fragmentary section taken generally along line 6—6 of FIG. 4.
FIG. 7 is a frontal section taken generally along line 7—7 of FIG. 6, with parts broken away.
FIG. 8 is a fragmentary perspective similar to FIG. 3, except showing an extended third section, with parts broken away for clarity.
FIG. 8A fragmentary perspective of the channel member with the diverter place.
FIG. 9 is a sectional view taken along line 9—9 of FIG. 8, also showing a bottom water diverter, inserted and cemented in place.
FIG. 9A vertical sectional view similar to FIG. 6 and FIG. 6A showing the relationship between the extended third section and the siding.

FIG. 6 is a fragmentary section taken generally along line 6—6 of FIG. 4 which shows the spatial relationship of the lap siding 23 and the D-channel member 22. Further, the full length of the drainage channel 34 is depicted, demonstrating the advantageous movement of drainage water 61 away from the surface 50 of the structure.

FIG. 6A is a similar view as in FIG. 6 showing the prior art J-channel. As shown, drainage water 61 is able to drain towards the surface of the structure.

FIG. 7 is a frontal section taken generally along line 7—7 of FIG. 6 which shows drainage water 61 being guided into the drainage channel 34 near the top of the structure opening. It should be noted that a section 71 of J-channel 22*a* has been bent 90 degrees so as to overlap section 31.

FIG. 8 is a fragmentary perspective of the end of a modified D-channel, having an extended third section 32, which extension is designated by reference numeral 62. For clarity, extension 62 has been cut away in FIG. 8. FIG. 8 illustrates an alternative method of securing fourth section 33 to first section 30 and third section 32. As shown in the drawing, fourth section 33 slides in groove 64 of first section 30 and groove 70 of third section 32. FIG. 8 also illustrates endcap diverter 63, which comprises end piece 65 and side pieces 66 and 68. Diverter 63 fits snugly into channel 34, and may be glued or cemented in place, as shown in FIG. 8A. The outer surface of piece 66 is cemented to the channel facing surface of fourth section 33 and the outer surface of piece 68 is cemented to the channel facing surface of second section 31.

FIG. 8A is a fragmentary perspective of the end of the modified D-channel, clearly showing extension 62 of third section 32, and showing how diverter 63 forms open space 41 in channel 34.

FIG. 9 is a longitudinal section, taken generally along line 9—9 of FIG. 8. This drawing shows how fastening device 60 is positioned in slot 35, and shows channel 34 and diverter 63 mounted in the bottom of the channel.

FIG. 9A is a fragmentary section taken generally along line 9A—9A of FIG. 8, and clearly shows that the annular lip 36 of extension 62 fits snugly against siding 23, creating open drainage space 51 for water 61.

Figure 10:
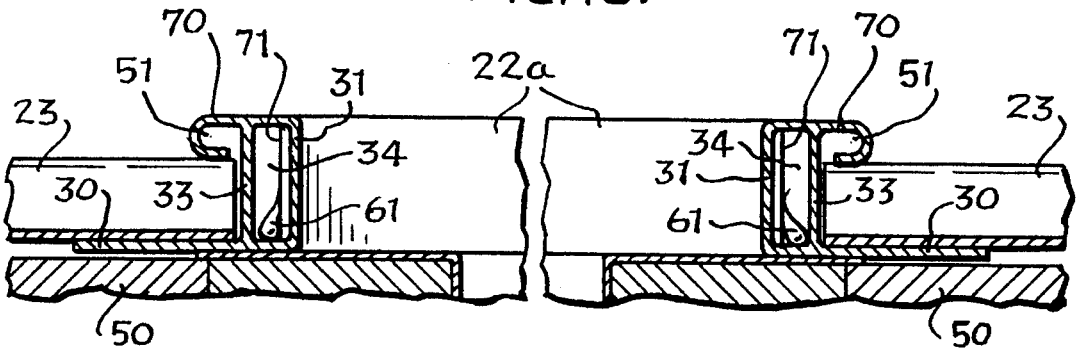
FIG. 10 is a view similar to FIG. 4 looking upwardly generally along line 10—10 of FIG. 1.

FIG. 10 is a view similar to FIG. 4, looking upwardly generally along line 10—10 of FIG. 1 showing the guiding of drainage water 61 through channel 34 of the D-channel member. It should be noted that the water is not able to flow towards the surface of the structure. Specifically, water is restricted to flow either in channel 34 or in channel 51.

Figure 11:
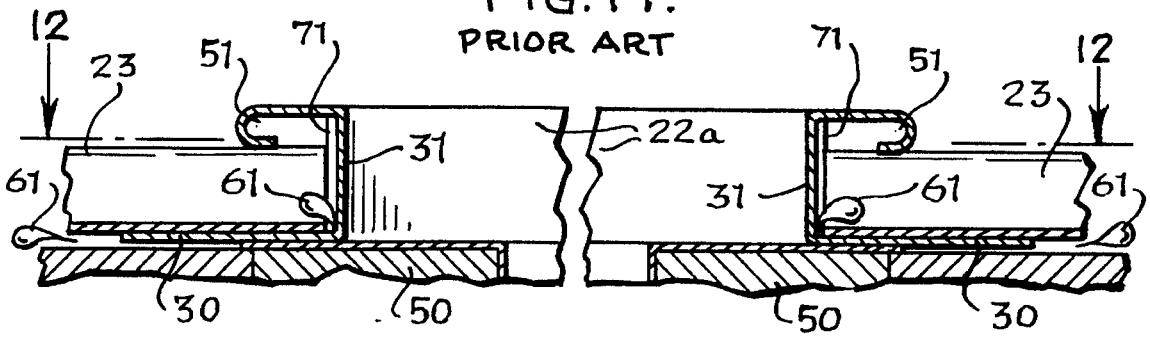
FIG. 11. PRIOR ART
FIG. 11 is a view similar to the view of FIG. 10 showing the prior art.

FIG. 11 is a view similar to the view of FIG. 10 showing the prior art. As is evident, drainage water is able to flow towards the surface of the structure.

This extraneous water may drain or be carried by capillary action over the surfaces beneath the siding.

Figure 12:
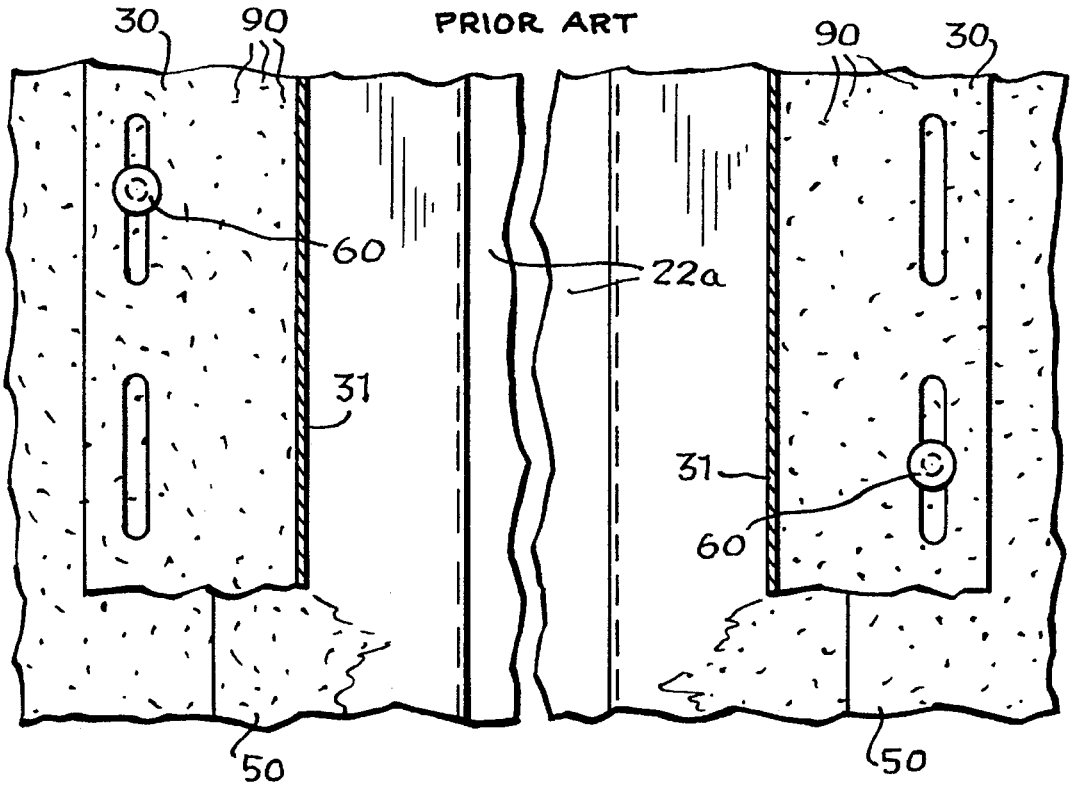
FIG. 12. PRIOR ART
FIG. 12 is a face frontal view taken generally along line 12—12 of FIG. 11 showing the prior art.

FIG. 12 is a face frontal view taken generally along line 12—12 of FIG. 11 showing the prior art. The stippling 90 signifies the presence of drainage water that has drained or been carried by capillary action along the surfaces behind the siding. It is the accumulation of this extraneous water which may cause deterioration and damage to these underlying surfaces.

By forcing drainage water away from the surface of the structure, the present invention prevents the accumulation of drainage water behind the lap siding.

Further, since the present invention guides drainage water away from the surfaces of the structure, the amount of extraneous sealants, e.g., caulking materials, usually required in large quantities during installation of prior channel members to prevent water from draining behind the surface of the lap siding, is thereby reduced.

In addition, by preventing the accumulation of drainage water, the present invention will minimize the warm and moist environment created by the deterioration of the wood, thereby decreasing the potential for infestation by insect pests such as ants, termites, bees, wasps or the like.

Although the dimensions of the D-channel of the present invention may vary, in one form of the invention, the D-channel has a typical wall thickness of approximately 1 millimeter (mm), the first section is approximately 40 mm wide, the second section is approximately 23 mm wide, the third section is approximately 5 mm wide, and fourth section is approximately 23 mm wide. Further, the fifth section is approximately 5 mm wide, whereas the sixth section can extend 15 mm beyond the edge of the first section.

Also, the present invention may be supplied in various lengths as according to industry standards, e.g., approximately 3.8 meters. The inturned annular lip 36 has a radius of approximately 5 mm and an overall height of approximately 5 mm.

Also, each of the slots in the first section may be located, for example, approximately 8 mm from the outer edge of the first section and have a length of approximately 30 mm and a width of approximately 4 mm.

The D-channel member of the present invention can be installed by any method now known or contemplated by those skilled in the art of the present invention.

From the foregoing, it will now be apparent that the present invention provides a D-channel for use in securing lap siding of a nature whereby water filtration can be readily dissipated. The D-channel forces draining water to flow down the channel and then out and over the outside surface of the siding. The D-channel is partially occluded at the bottom, forcing the water to spill out at the furthest distance from the surface being sided. Also, a modified embodiment of the present invention provides a means to direct surface water to a drainage lip located on the D-channel in order to force the water away from the siding.

Moreover, the shape of the D-channel ensures a snug fit against the sheathing and nailing flange of a window, door or louver frame surrounding the window, and also securely hugs the ends of the siding to aid in holding the siding down and enhance the overall appearance. Finally, the above-described drainage characteristics of the D-channel will reduce the amount of extraneously applied sealing material necessary to prevent water drainage behind the siding.

Although the invention has been shown and described in respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A channel member for securing lap siding about an opening in a structure, comprising:

a.) a first substantially flat section arranged to mount said channel to a surface of said structure;

b.) a second section extending outwardly from an edge of said first section and also extending essentially perpendicularly outwardly from said first section;

c.) a third section extending perpendicularly from an edge of said second section and arranged in a spaced apart parallel relationship with respect to said first section;

d.) a fourth section secured to said first and third sections in a spaced apart parallel relationship with respect to said second section, wherein said first, second, third and fourth sections form a closed drainage channel; and, e.) a diverter member secured at one end of said closed channel to edges of said first, second, and fourth sections to partially occlude said channel, and to form a drainage opening between said second, third, and fourth sections and said diverter member.

2. A channel member according to claim 1, wherein said channel member is comprised of a relatively rigid plastic material such as a vinyl or polyvinyl resin.

3. A channel member according to claim 1, wherein said channel member is comprised of a metal such as aluminum or alloys thereof.

4. A closure assembly having, in combination, a channel member with lap siding about an opening in a building structure, comprising:

a.) an opening in a building structure;

b.) lap siding;

c.) a channel member operatively arranged to mount said siding about said opening, where said channel comprises:

d.) a first substantially flat section arranged to mount said channel to a surface of said structure;

e.) a second section extending outwardly from an edge of said first section and also extending essentially perpendicularly outwardly from said first section;

f.) a third section extending perpendicularly from an edge of said second section and arranged in a spaced apart parallel relationship with respect to said first section; and, g.) a fourth section secured to said first and third sections in a spaced apart parallel relationship with respect to said second section, wherein said first, second, third and fourth sections form a closed drainage channel, wherein said lap siding is secured atop said first substantially flat section and wherein said third section isolates said lap siding from said closed drainage channel.

5. A closure assembly according to claim 4, wherein said channel member is comprised of a relatively rigid plastic material such as a vinyl or polyvinyl resin.

6. A closure assembly according to claim 4, wherein said channel member is comprised of a metal such as aluminum or alloys thereof.

7. A closure assembly according to claim 4, wherein said third section includes an extension member to facilitate lap siding to be mounted substantially flush against said extension.

8. A closure assembly according to claim 7, wherein said channel member is comprised of a relatively rigid plastic material such as a vinyl or polyvinyl resin.

9. A closure assembly according to claim 7, wherein said channel member is comprised of a metal such as aluminum or alloys thereof.

* * * * *